US005284529A

United States Patent [19]

Shikanai et al.

[11] Patent Number: 5,284,529

[45] Date of Patent: * Feb. 8, 1994

[54] ABRASION-RESISTANT STEEL

[75] Inventors: Nobuo Shikanai; Yasunobu Kunisada; Tetsuya Sanpei; Kazunori Yako; Kenji Hirabe, all of Kawasaki, Japan

[73] Assignee: NKK Corporation, Tokyo, Japan

[ * ] Notice: The portion of the term of this patent subsequent to Aug. 17, 2010 has been disclaimed.

[21] Appl. No.: 23,865

[22] Filed: Feb. 26, 1993

Related U.S. Application Data

[63] Continuation of Ser. No. 847,723, Mar. 6, 1992, abandoned, which is a continuation-in-part of Ser. No. 621,587, Dec. 3, 1990, abandoned.

[30] Foreign Application Priority Data

Jun. 6, 1990 [JP] Japan ..... 1-48400

[51] Int. Cl.[5] ..... C22C 38/14

[52] U.S. Cl. ..... 148/328; 420/126

[58] Field of Search ..... 148/328; 420/126

[56] References Cited

FOREIGN PATENT DOCUMENTS 54-38571 11/1979 Japan .

1218927 11/1979 United Kingdom .

OTHER PUBLICATIONS

Proceedings of an International Symposium of High-Strength of Low-alloy Steels, Oct. 1975, pp. 55, 56, 67, 68, 155 and 156.

*Primary Examiner*—Deborah Yee

*Attorney, Agent, or Firm*—Frishauf, Holtz, Goodman & Woodward

[57] ABSTRACT

An abrasion-resistant steel consists essentially of 0.05 to 0.45 wt. % C, 0.1 to 1 wt. % Si, 0.1 to 2 wt. % Mn, 0.05 to 1.5 wt. % Ti and the balance being Fe and inevitable impurities, the steel includes at least 200 of precipitates of 1 μm or more in particle size per 1 $mm^2$ and the precipitates contains Ti.

In addition to the above basic elements, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % B is added to steel or at least one element selected from the group consisting of 0.005 to 1 wt. % Nb and 0.01 to 1 wt. % V is added to steel.

39 Claims, 3 Drawing Sheets

ABRASION-RESISTANT STEEL

This application is a continuance of application Ser. No. 07/847,723, filed Mar. 6, 1992, which is a continuation-in-part of Ser. No. 07/621,587 filed Dec. 3, 1990, both now abandoned.

CROSS REFERENCE TO RELATED APPLICATIONS

This is a continuation-in-part application of Ser. No. 07/621,587 filed on Dec. 3, 1990. An application naming the same inventors entitled ABRASION-RESISTANT STEEL directed to related subject matter is also being filed Mar. 6, 1992. Said application Ser. No. 07/621,587 and said related application being filed Mar. 6, 1992 are hereby incorporated herein by this reference.

BACKGROUND OF THE INVENTION

The present invention relates to an abrasion resistant steel used in the fields of construction, civil engineering and mining such as in power shovel, bulldozer, hopper and bucket.

DESCRIPTION OF THE RELATED ART

Abrasion resistant steels are used in the fields of construction, civil engineering and mining such as in power shovel, bulldozer, hopper and bucket to keep the service lives of these machines or their parts. Since abrasion resistance of steel is increased by increasing hardness of steel, steel having a high hardness manufactured by applying heat treatments such as quenching and the like to an alloyed steel has previously been used.

Methods for manufacturing an abrasion-resistant steel with high hardness are disclosed in Japanese Patent Application Laid Open No. 142726/87, No. 169359/88 and No. 14023/89. It is an object of those methods to obtain an abrasion-resistant steel by determining the Brinell Hardness of steel at about 300 or more and improving weldability, toughness and workability in bending. That is, the abrasion resistance of steel is obtained by attaining a high hardness of steel.

In recent years, however, the properties required for abrasion-resistant steel have become severer and the essential solution to a higher abrasion resistance of steel will not be obtained by simply increasing the hardness of steel. When the hardness of steel is greatly increased on the basis of the conventional technology, weldability and workability of steel deteriorate, and the production cost greatly increases due to a high alloying. Accordingly, it is easily anticipated that it is difficult in practical use to greatly increase the hardness of steel for the purpose of increasing the abrasion resistance of commercial steel.

The present invention is devised from a viewpoint quite different from the aforementioned idea on the production of abrasion-resistant steel, namely, the idea of increasing the abrasion resistance of steel by attaining a high hardness.

SUMMARY OF THE INVENTION

It is an object of the present invention to provide an abrasion-resistant steel obtained by increasing only the abrasion resistance of steel without greatly increasing the hardness of steel.

The present invention provides an abrasion-resistant steel consisting essentially of 0.05 to 0.45 wt. % C, 0.1 to wt. % Si, 0.1 to 2 wt. % Mn, 0.05 to 1.5 wt. % Ti and the balance being Fe and inevitable impurities, said steel including at least 200 of precipitates of 1 μm or more in average particle size per 1 $mm^2$ and said precipitates containing Ti.

The present invention provides another abrasion-resistant steel consisting essentially of 0.05 to 0.45 wt. % C, 0.1 to 1 wt. % Si, 0.1 to 2 wt. % Mn, 0.05 to 1.5 wt. % Ti, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % B and the balance being Fe and inevitable impurities, said steel including at least 200 of precipitates of 1 μm or more in average particle size per 1 $mm^2$ and said precipitates containing Ti.

The present invention provides still another abrasion-resistant steel consisting essentially of 0.05 to 0.45 wt. % C, 0.1 to 1 wt. % Si, 0.1 to 2 wt. % Mn, 0.05 to 1.5 wt. % Ti, at least one element selected from the group consisting of 0.005 to 1 wt. % Nb and 0.01 to 1 wt. % V and the balance being Fe and inevitable impurities, said steel including at least 200 of precipitates of 1 μm or more in average particle size per 1 $mm^2$ and said precipitates containing Ti.

The present invention provides yet another abrasion-resistant steel consisting essentially of 0.05 to 0.45 wt. % C, 0.1 to 1 wt. % Si, 0.1 to 2 wt. % Mn, 0.05 to 1.5 wt. % Ti, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % B, at least one element selected from the group consisting of 0.005 to 1 wt. % Nb and 0.01 to 1 wt. % V and the balance being Fe and inevitable impurities, said steel including at least 200 of precipitates of 1 μm or more in average particle size per 1 $mm^2$ and said precipitates containing Ti.

The above objects and other objects and advantages of the present invention will become apparent from the following detailed description, taken in conjunction with the appended drawings.

DESCRIPTION OF THE PREFERRED EMBODIMENT

Figure 1:
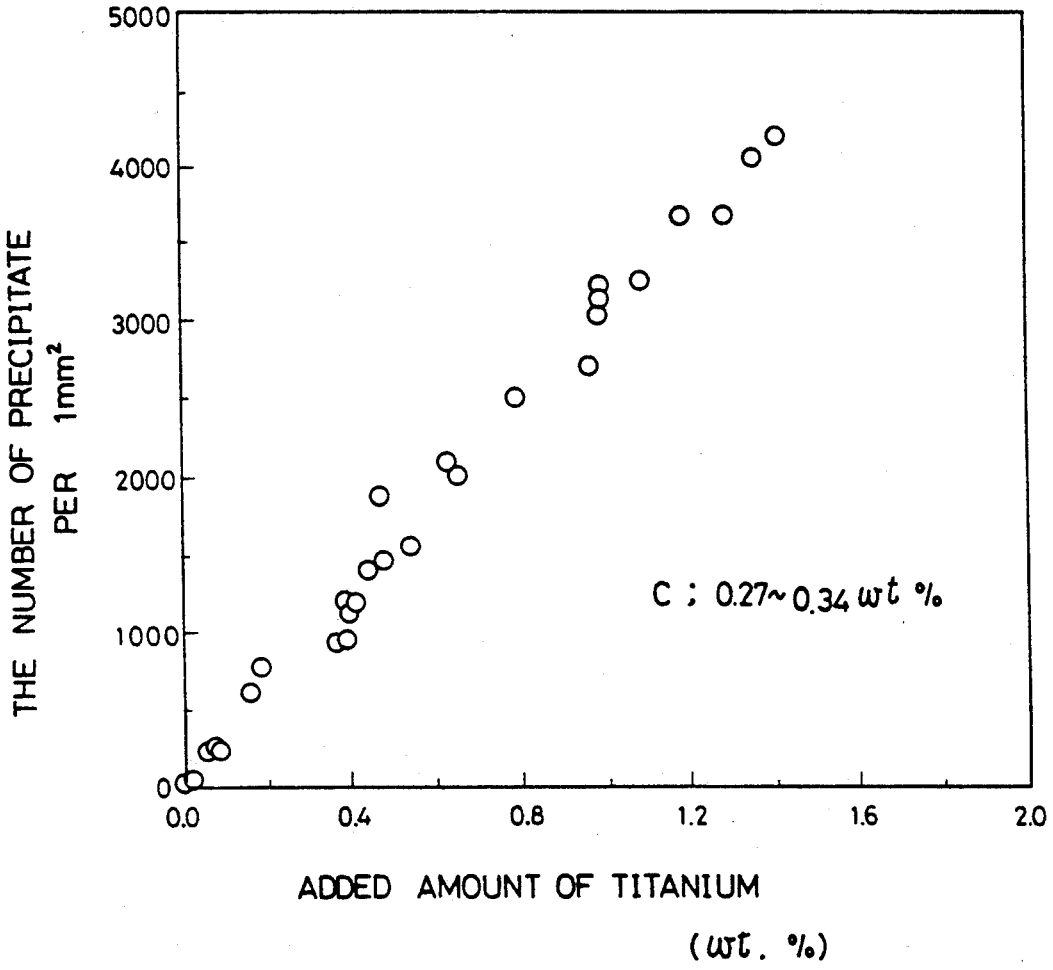
FIG. 1 is a graphical representation showing the relationship between the added amount of titanium and the number of precipitate of the present invention.

The most significant feature of the present invention is to increase the abrasion resistance of steel by adding a great amount of titanium to steel and effectively utilizing hard coarse precipitates containing titanium. Accordingly, it is unnecessary in the present invention to enhance hardness of abrasion-resistant steel by only transforming the structure of steel to a martensite, which is the conventional way of enhancing the abrasion resistance of steel.

The conventional abrasion-resistant steel obtained by adding titanium to the steel is known. In the conventional way, the purpose of addition of titanium to steel is mainly to fix nitrogen as TiN liable to combine with B in order to secure solution boron effective for quenching hardenability, and the added amount of Ti is about 0.02 wt. % or less. The addition of a large quantity of titanium to steel has been generally limited due to the oxidation of titanium in the steel making stage, clogging of nozzles and reaction of titanium with an oxidation preventing powder in the casting stage. Therefore, the effect of the addition of a large quantity of titanium to steel has been not yet known.

When attempts are made to produce the effect (precipitation hardening) of an increase of the strength of steel by using TiC, about 0.05 wt. % Ti is often added to steel. For the precipitation hardening, the particle size of a precipitate has been required to limit to 0.1 μm or less.

The inventors found after having conducted their detailed examination that the abrasion resistance of steel could be greatly increased by adding a great amount of titanium to steel and causing coarse precipitates of 1 μm or more in average particle size consisting mainly of TiC or TiN as precipitates, which do not contribute to the precipitation hardening, to precipitate and disperse in large quantities. The feature of the present invention is not only to simply add a large quantity of titanium to steal, but also to utilize the coarse precipitates of 1 μm or more in average particle size, which have not been considered completely in a traditional common sense and moreover have been regarded as rather harmful. Since those coarse precipitates do not contribute to the precipitation hardening, the strength and hardness of steel are not increased. Accordingly, only the abrasion-resistance of steel of the present invention, which has a hardness equal to that of the prior art steel or smaller than that of the prior art steel, can be greatly increased.

The precipitates in steel of the present invention are composed of TiC, TiN and TiS. Precipitates of NbC and NbN are present in steel, to which Nb is added. Precipitates of VC and VN are present in steel, to which V is added. Precipitates of Nb C, NbN, VC and VN are simultaneously present in steel, to which Nb and V are added. Precipitates containing Ti, Nb and V simultaneously are also present in the steel. As described above, in increasing the abrasion resistance of steel, the precipitates containing Ti are most effective. The precipitates containing Nb and V are also effective in an increase of the abrasion resistance of steel.

The reason why the contents of elements of the invented steel are specified will now be described as follows:

C is an indispensable element in formation of the precipitates containing Ti and has an effect of increase of the hardness of steel. When a great amount of C is added to steel, the weldability and workability of steel are deteriorated. Therefore, the upper limit of addition of C is determined at 0.45 wt. %. The lower limit of addition of C is determined at 0.05 wt. % which is an amount necessary for realizing the effect of TiC as one of the precipitates containing Ti.

Si is an element effective in deoxidation process of steel making and a minimum addition of 0.1 wt. % Si is required for this purpose. Si is also an effective element for solution hardening. However, an addition of Si to steel over 1 wt. % lowers the toughness of steel and increases inclusions in steel.

In consequence, the content of Si in steel is limited to a range of from 0.1 to 1 wt. %.

Mn is an element effective in quenching hardenability of steel. From this point of view, at least 0.1 wt. % Mn is required for this purpose. However, when the Mn content exceeds 2 wt. %, the weldability of steel is deteriorated. Therefore, the Mn content is determined at 0.1 to 2 wt. %.

Ti is one of the most important elements as is C. The addition of at least 0.05 wt. % Ti is required to stably form a great amount of coarse precipitates containing Ti. The addition of 0.2 wt. % Ti or more is preferable to stably generate a greater amount of precipitates containing Ti and to secure a better abrasion resistance of steel. FIG. 1 is a graphical representation showing the relationship between the added amount of Ti and the number of the precipitates containing Ti. When more than 1.5 wt. % Ti is added to steel, the steel possesses good abrasion resistance. However, a high cost is required for the production. The weldability and workability of steel lowered. The quenching hardenability of steel is also lowered. Therefore, the Ti content is required to be 0.05 to 1.5 wt. % and preferably 0.2 to 1.5 wt. %.

In addition to the above basic elements, if necessary, at least one element selected from the group consisting of Cu, Ni, Cr, Mo and B can be added to steel within the following range to enhance the quenching hardenability.

Cu is an element for enhancing the quenching hardenability of steel. However, when the Cu content is below 0.1 wt. %, the effect is not sufficient. When the Cu content exceeds 2 wt. %, the hot workability of steel is lowered and the production cost is increased. Therefore, the Cu content is determined at 0.1 to 2 wt. %. Moreover, to prevent the production cost from increasing and to secure the effect of addition of Cu to steel, the Cu content is desired to be in the range of 0.2 to 1.0 wt. %.

Ni is an element which enhances the quenching hardenability of steel. When the Ni content is below 0.1 wt. %, the effect is not sufficient. When the Ni content exceeds 10 wt. %, the production cost is greatly increased. Therefore, the Ni content is determined at 0.1 to 10 wt. %. Ni also is effective in increase of the low-temperature toughness. To prevent the production cost from increasing and to secure the effect of addition of Ni to steel, the Ni content is desired to be from 0.2 to 1.5 wt. %.

Cr is an element which enhances the quenching hardenability of steel. When the Cr content is below 0.1 wt. %, the effect is not sufficient. When the Cr content exceeds 3 wt. %, the weldability of steel is deteriorated and the production cost is increased. Therefore, the Cr content is determined at 0.1 to 3 wt. %. To prevent the production cost from increasing and to secure the effect of addition of Cr to steel, the Cr content is desired to be from 0.2 to 1.5 wt. %.

Mo is an element which enhances the quenching hardenability of steel. When the Mo content is below 0.1 wt. %, the effect is not sufficient. When the Mo content exceeds 3.0 wt. %, the weldability of steel is deteriorated and the production cost is increased. Therefore, the Mo content is determined at 0.1 to 3 wt. %. The Mo content is desired to be from 0.1 to 1 wt. % in terms of the production cost.

B is an element whose quenching hardenability is enhanced by adding a very small amount of B to steel. When the B content is below 0.0003 wt. %, the effect is not sufficient. When the B content exceeds 0.01 wt. %, the weldability of steel is deteriorated and simultaneously the quenching hardenability of steel is lowered. Therefore, the B content is determined at 0.0003 to 0.01 wt. %. To prevent the production cost from increasing and to secure the effect of addition of B to steel, the B content is desired to be from 0.0005 to 0.005 wt. %.

To increase the precipitation hardening in steel in the present invention, at least one element selected from the group consisting of Nb and V can be added to steel within the following range:

Nb is an element effective in the precipitation hardening of steel and can control the hardness of steel according to the use of steel. When the Nb content is below 0.005 wt. %, the effect is not sufficient. Nb is also effective in forming coarse precipitates as is Ti. When the Nb content is over 1 wt. %, the weldability of steel is deteriorated. Therefore, the Nb content is required to be from 0.005 to 1 wt. %. To prevent the production cost from increasing and to secure the effect of addition of Nb to steel, the Nb content is desired to be from 0.01 to 0.5 wt. %.

V is an element effective in the precipitation hardening and can control the hardness of steel according to the use of steel. When the V content is below 0.01 wt. %, the effect is not sufficient. V is also effective in formation of coarse precipitates as is Ti. However, when the V content exceeds 1 wt. %, the weldability of steel is deteriorated. Therefore, the V content is required to be from 0.01 to 1 wt. %. To prevent the production cost from increasing and to secure the effect of addition of V to steel, the V content is desired to be from 0.03 to 0.5 wt %.

The steel of the present invention is manufactured on condition that 200 or more of coarse precipitates of 1.0 μm in average particle size containing titanium are present per 1 $mm^2$.

The abrasion resistance of steel as the most important feature of steel of the present invention can be obtained by causing the coarse precipitates containing Ti to be present in large quantities in the steel. When the precipitates have a small average particle size of less than 1 μm, the effect of increasse of the abrasion resistancce is small. Moreover, since the precipitates having such a small particle size is accompanied by the increase of the hardness and strength of steel due to the precipitation hardening, the object of the present invention cannot be attained. Accordingly, the object of the composition of the present invention is the coarse precipitates of 1 μm or more in average particle size.

However, even in the case where the precipitates of 1 μm or more in average particle size are present in steel, when the number of precipitates per 1 $mm^2$ is less than 200, there is little effect of increase of the abrasion resistance of steel. It is understood that a great amount of precipitates numbering 200/$mm^2$ or more are required to obtain the effect of increase of a good abrasion resistance of steel. Accordingly, the steel of the present invention can be manufactured on condition that 200 or more of coarse precipitates of 1.0 μm in average particle size containing titanium are present per 1 $mm^2$. 500 or more of coarse precipitates containing Ti per 1 $mm^2$ are desired to obtain a better abrasion resistance of steel.

Figure 2:
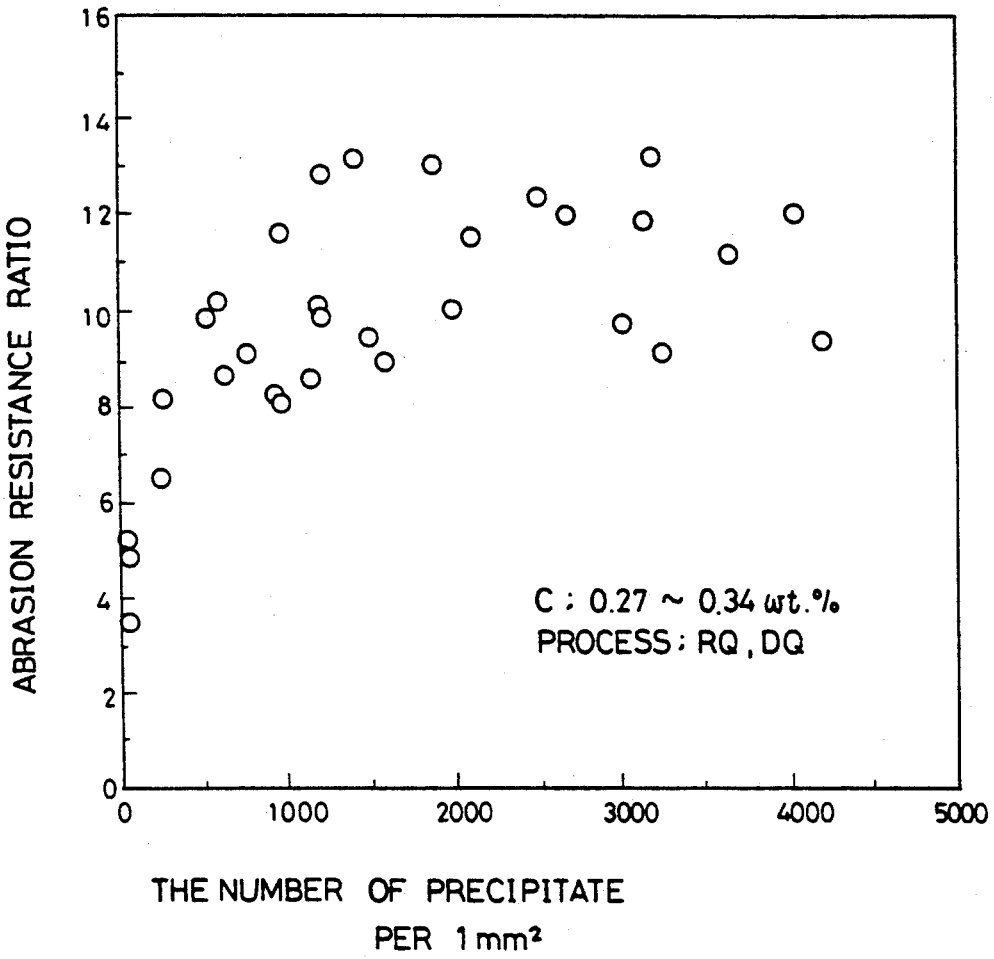
FIG. 2 is a graphical representation showing the relationship between the number of coarse precipitates of 1.0 to 50 μm in average particle size per 1 $mm^2$ and the abrasion resistance of the present invention.
Figure 3:
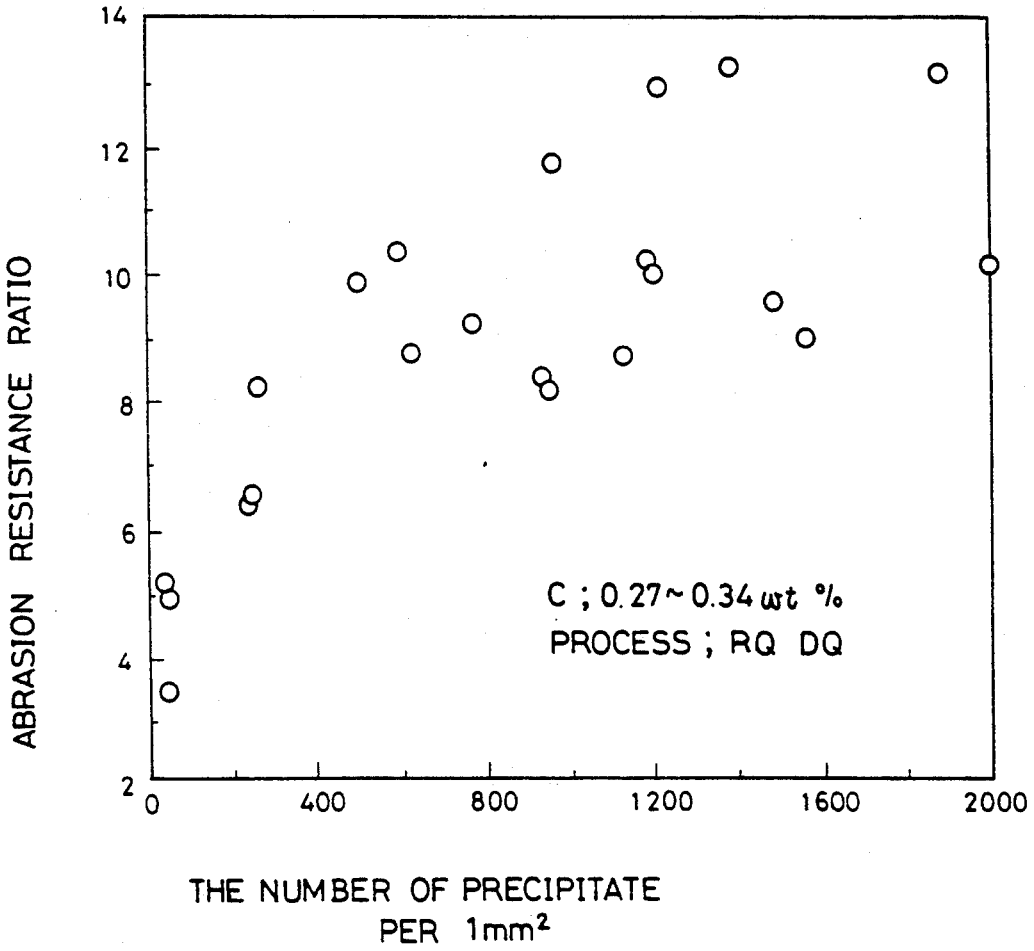
FIG. 3 is a graphical representation showing in detail the range of 2000 of coarse precipitates or less per 1 $mm^2$ in FIG. 2.

FIGS. 2 and 3 are graphical representation showing the relationship between the amount (the number of the precipitates per 1 $mm^2$) of the coarse precipitates containing Ti and the abrasion resistance of steel (the abrasion resistance ratio = the magnification of the abrasion resistance of the objective steel when the abrasion resistance of a soft steel is determined at 1). According to this graphical representation, it is clearly seen that when the number of the precipitates is 200/$mm^2$ or more, a good abrasion resistance of steel can be obtained and that when the number of the precipitates is 500/$mm^2$ or more, a better abrasion resistance of steel can be obtained.

However, since the coarse precipitates containing Ti of more than 50 μm in average particle size are liable to drop out, the effect of increase of the abrasion resistance cannot be expected. Besides this, since the toughness of steel is greatly decreased when such extremely coarse precipitates are present in steel in large quantities, it is better that the coarse precipitates containing Ti of more than 50 μm in average particle size are not present in steel. Accordingly, it is desirable that 200 or more of precipitates of 50 μm or less in average particle size are present per 1 $mm^2$.

In the present invention, if 200 or more of precipitates of 1 μm in average particle size per 1 $mm^2$, preferably 500 or more of precipitates, are present, the predetermined abrasion resistance can be obtained. So long as the condition as mentioned above is satisfied, it is no trouble that precipitates other than precipitates including titanium are present or precipitates of less than 1 μm containing Ti are present.

Since a desired abrasion resistance of steel of the present invention can be obtained by only specifying the composition of the steel and the precipitation containing Ti, it is not necessary to specify the working condition and heat treatment condition. Accordingly, the heat treatments such as quenching, annealing, aging and stress relief annealing can be executed optionally and even when those heat treatments of the steel are carried out, the feature of the steel of the present invention cannot be impaired.

To generate the aforementioned coarse precipitations of 1.0 μm or more in particle size, it is necessary to control a solidification rate of steel during casting of the steel. The solidification rate is required to be $10^2$ [°C./min] or less. When the solidification rate exceeds $10^2$ [°C./min], the solidification rate is extremely great. Even if an amount of Ti satisfying the conditions of the present invention is added to steel, the precipites become fine as a whole and it becomes difficult to generate 200/$mm^2$ of precipitates of 1 μm or more in average particle size, which should be the condition of the present invention. However, since the solidification rate of less than $1/10^2$ [°C./min] is too slow, the aforementioned extremely coarse precipitates of more than 50 μm are liable to be generated. Accordingly, the solidification rate is desired to be $1/10^2$ [°C./min] or more.

Steel of the present invention is desired to have hardness of 550 or less as a hardness level of steel for practical use.

EXAMPLE

The chemical compositions of samples are shown in Tables 1 to 3. Samples of from A to Z and from "a" to "c" are made of steel of the present invention. Samples of from ① to ④ are made of the steel for comparison. The comparison steels ① and ② are steels whose Ti content is beyond the range of the present invention. The steels ③ and ④ for comparison are steels whose C content is beyond the range of the present invention (the Ti content is within the range of the present invention).

The process of making steels (15 mm in thickness) manufactured by using each of the samples, the abrasion resistance ratio, the hardness HB (the Brinell Hardness on the surface of the samples) and the amount of precipitates (the number of precipitates of from 1.0 to 50 μm in average particle size per 1 $mm^2$) are shown in Tables 4 to 6.

The abrasion resistance ratio is a ratio estimated by a change of weight of steel in an abrasion resistance test. In this test, when the abrasion resistance of soft steel is determined at 1.0, the magnification of the abrasion resistance of a sample is represented as an abrasion resistance of the sample. The abrasion resistance of the sample is represented with the foumula: [abraded weight of the soft steel/abraded weight of the sample]. Accordingly, the greater the abrasion resistance ratio of steel, the better the abrasion resistance of steel. Silica sand containing 100% $SiO_2$ was used as abrasives.

The processes in the Tables are classified as follows:

AR: as rolled;

RQ: as quenched after heated to 900° C. following the rolling and air-cooling;

RQT: as tempered at the temperature shown in the parenthesis after RQ treatment;

DQ: as directly quenched after finish rolled at 880° C. following the heating of the slab at 1150° C.;

DQT: as tempered at the temperature shown in the parenthesis following DQ; and

QT: as tempered at the temperature shown in the parenthesis following Q.

The steel for comparison (1) corresponds to the steel A, B-1 and D of the present invention and the Ti content is below the lower limit specified by the present invention. The number of precipitates of 1.0 μm or more in particle size also is below the lower limit specified by the present invention. The abrasion resistance ratio of the steel for comparison (1) is 4.9. On the other hand, the abrasion resistance ratio of steel A of the present invention is 6.5. The abrasion resistance ratio of steel B-1 is 8.3. The abrasion resistance ratio of steel D is 9.3. Although the abrasion resistances of the steels of the present invention are various depending on the Ti contents and the number of the coarse precipitates, the abrasion resistance of the steel D of the present invention is increased about twice as many as that of the steel for comparison (1). The hardness of the steel of the present invention is rather lower than that of the steel for comparison (1). Therefore, it is clearly seen that the object of the present invention, which is to increase only the abrasion resistance of steel without enhancing the hardness of the steel, is attained.

Similarly, the steel for comparison (2) corresponds to the steel L and N of the present invention. It is clearly seen that the abrasion resistance superior to that of the steel for comparison can be obtained in any of the steel of the present invention. The steel for comparison (3) corresponds to the steel B-1. Although the Ti content satisfies the conditions of the present invention, the number of the coarse precipitates of 1.0 μm or more in particle size is below the lower limit specified by the present invention since the C content is below the lower limit specified by the present invention. Therefore, it is clearly seen that the abrasion resistance of the steel for comparison is greatly inferior to that of the steel of the present invention. In the steel for comparison (4), the contents of allowing elements other than C and the number of the coarse precipitates are beyond the range of the present invention and only the C content is higher than the upper limit specified by the present invention. Although the abrasion resistance of the steel for comparison (4) is good, the steel has a very high hardness of 616. In consequence, the workability and weldability of the steel is greatly inferior to those of the steel of the present invention. The steel for comparison cannot be put to parctical use.

As described above, steel of the present invention has a good abrasion resistance, having the hardness equal to or below that of the conventional steel. The steel of the present invention is a good abrasion-resistant steel having a good abrasion resistance, workability and weldability, which has been ever seen. Therefore, it becomes possible to greatly increase the service lives of spare parts of machines which have been greatly abraded and have had a short service lives, and the spare parts which require complicated working and an abrasion resistance can be easily manufactured.

TABLE 1

| | Chemical Composition (wt. %, B and N in ppm) | | | | | | | | | | | | |
|---|---|---|---|---|---|---|---|---|---|---|---|---|---|
| | C | Si | Mn | Cu | Ni | Cr | Mo | Nb | V | Ti | B | N | |
| A | 0.30 | 0.36 | 0.70 | — | — | — | — | — | — | 0.09 | — | 33 | Present Invention |
| B | 0.28 | 0.37 | 0.73 | — | — | — | — | — | — | 0.37 | — | 38 | Present Invention |
| C | 0.29 | 0.37 | 0.74 | — | — | — | — | — | — | 0.98 | — | 36 | Present Invention |
| D | 0.29 | 0.36 | 0.71 | — | — | — | — | — | — | 1.41 | — | 30 | Present Invention |
| E | 0.28 | 0.36 | 0.71 | 0.24 | 0.29 | — | — | — | — | 0.40 | — | 31 | Present Invention |
| F | 0.31 | 0.33 | 0.73 | — | — | 1.02 | 0.23 | — | — | 1.08 | 10 | 32 | Present Invention |
| G | 0.19 | 0.33 | 1.44 | — | — | 0.27 | — | — | — | 0.65 | 9 | 22 | Present Invention |
| H | 0.14 | 0.34 | 1.40 | — | — | — | — | 0.025 | — | 0.40 | — | 24 | Present Invention |
| I | 0.32 | 0.34 | 0.72 | — | — | — | — | — | 0.045 | 0.41 | — | 21 | Present Invention |
| J | 0.34 | 0.26 | 1.01 | 0.35 | 0.55 | — | — | 0.028 | 0.041 | 0.54 | — | 42 | Present Invention |
| K | 0.31 | 0.38 | 0.71 | — | — | 0.99 | 0.23 | 0.022 | 0.044 | 0.06 | 8 | 24 | Present Invention |
| L | 0.29 | 0.38 | 0.70 | — | — | 0.99 | 0.23 | — | 0.044 | 0.08 | 9 | 23 | Present Invention |

TABLE 2

| | Chemical Composition (wt. %, B and N in ppm) | | | | | | | | | | | | |
|---|---|---|---|---|---|---|---|---|---|---|---|---|---|
| | C | Si | Mn | Cu | Ni | Cr | Mo | Nb | V | Ti | B | N | |
| M | 0.30 | 0.36 | 0.71 | 0.25 | — | 0.55 | — | 0.045 | 0.19 | 8 | 30 | 33 | Present Invention |
| N | 0.31 | 0.36 | 0.71 | — | — | 1.02 | 0.23 | — | 0.045 | 0.38 | 8 | 31 | Present Invention |
| O | 0.31 | 0.33 | 0.73 | — | 0.36 | 0.63 | 0.34 | — | — | 1.28 | — | 32 | Present Invention |
| P | 0.32 | 0.41 | 1.51 | — | — | — | — | 0.091 | — | 0.38 | — | 49 | Present Invention |
| Q | 0.33 | 0.37 | 1.62 | — | — | — | — | 0.154 | — | 0.98 | — | 45 | Present Invention |
| R | 0.33 | 0.26 | 0.62 | — | — | 0.88 | 0.23 | 0.070 | — | 0.44 | 15 | 33 | Present Invention |
| S | 0.28 | 0.35 | 0.71 | — | — | 0.95 | 0.26 | 0.453 | — | 0.47 | 12 | 34 | Present Invention |
| T | 0.30 | 0.37 | 0.70 | — | — | 0.95 | 0.24 | 0.219 | — | 1.35 | 9 | 38 | Present Invention |
| U | 0.18 | 0.44 | 1.52 | 0.38 | — | 0.78 | — | 0.416 | 0.050 | 0.28 | 13 | 30 | Present Invention |

TABLE 3

| | Chemical Composition (wt. %, B and N in ppm) | | | | | | | | | | | | |
|---|---|---|---|---|---|---|---|---|---|---|---|---|---|
| | C | Si | Mn | Cu | Ni | Cr | Mo | Nb | V | Ti | B | N | |
| V | 0.31 | 0.58 | 1.22 | — | — | — | — | 0.212 | 0.347 | 0.16 | 15 | 49 | Present Invention |
| W | 0.42 | 0.72 | 0.89 | — | — | — | — | 0.526 | — | 0.37 | 10 | 26 | Present Invention |
| X | 0.38 | 0.26 | 1.02 | 0.56 | — | 0.27 | — | 0.062 | 0.472 | 0.32 | — | 41 | Present Invention |
| Y | 0.27 | 0.33 | 0.73 | — | — | 0.32 | — | — | 0.261 | 0.41 | — | 55 | Present Invention |
| Z | 0.32 | 0.41 | 0.82 | — | — | 0.29 | — | — | 0.583 | 0.48 | 12 | 80 | Present Invention |
| a | 0.28 | 0.35 | 1.18 | — | — | 1.77 | — | — | — | 0.39 | 11 | 128 | Present Invention |
| b | 0.35 | 0.12 | 0.96 | 0.41 | 1.59 | 0.12 | 0.58 | — | — | 0.50 | — | 52 | Present Invention |
| c | 0.40 | 0.44 | 0.76 | — | — | 1.33 | 0.89 | — | — | 0.45 | — | 184 | Present Invention |
| ① | 0.30 | 0.30 | 0.75 | — | — | — | — | — | — | 0.02 | — | 37 | Comparison |
| ② | 0.30 | 0.30 | 0.96 | — | — | 1.83 | 0.21 | — | 0.045 | 0.01 | 11 | 47 | Comparison |
| ③ | 0.03 | 0.30 | 0.75 | — | — | — | — | — | — | 0.47 | — | 37 | Comparison |
| ④ | 0.53 | 0.35 | 1.50 | — | — | — | — | — | — | 0.31 | — | 51 | Comparison |

TABLE 4

| | Manufacturing Process | Abrasion Resistance Ratio | Hardness (HB) | Amount of Precipitates of 1.0 μm (number/mm$^2$) | |
|---|---|---|---|---|---|
| A | RQ | 6.5 | 474 | 241 | Invention |
| B-1 | RQ | 8.3 | 393 | 932 | Invention |
| B-2 | RQT (400° C.) | 6.1 | 277 | 901 | Invention |
| C-1 | DQ | 9.7 | 335 | 3011 | Invention |
| C-2 | DQT (400° C.) | 6.8 | 245 | 2989 | Invention |
| D | RQ | 9.3 | 242 | 4190 | Invention |
| E | RQ | 8.6 | 390 | 1132 | Invention |
| F | RQ | 9.1 | 321 | 3255 | Invention |
| G | RQ | 4.7 | 302 | 1208 | Invention |
| H | DQ | 3.4 | 253 | 533 | Invention |
| I | RQ | 10.1 | 451 | 1185 | Invention |
| J | DQ | 8.9 | 417 | 1560 | Invention |
| K | RQ | 6.4 | 503 | 236 | Invention |
| L-1 | AR | 4.5 | 293 | 253 | Invention |
| L-2 | DQ | 8.2 | 507 | 266 | Invention |

TABLE 5

| | Manufacturing Process | Abrasion Resistance Ratio | Hardness (HB) | Amount of Precipitates of 1.0 μm (number/mm$^2$) | |
|---|---|---|---|---|---|
| M-1 | AR | 4.7 | 286 | 799 | Invention |
| M-2 | RQ | 9.1 | 454 | 767 | Invention |
| N-1 | AR | 6.1 | 274 | 998 | Invention |

TABLE 5-continued

| | Manufacturing Process | Abrasion Resistance Ratio | Hardness (HB) | Amount of Precipitates of 1.0 μm (number/mm²) | |
|---|---|---|---|---|---|
| N-2 | RQ | 11.6 | 448 | 963 | Invention |
| O-1 | AR | 7.3 | 246 | 3760 | Invention |
| O-2 | RQ | 11.1 | 275 | 3658 | Invention |
| P-1 | RQ | 12.8 | 461 | 1210 | Invention |
| P-2 | AR | 9.0 | 271 | 1307 | Invention |
| Q-1 | RQ | 13.1 | 278 | 3211 | Invention |
| Q-2 | QT (500° C.) | 6.4 | 255 | 3186 | Invention |
| R | DQ | 13.1 | 448 | 1389 | Invention |
| S-1 | DQ | 13.0 | 409 | 1877 | Invention |
| S-2 | DQT (550° C.) | 7.6 | 297 | 2189 | Invention |
| T | RQ | 11.9 | 253 | 4035 | Invention |
| U | RQ | 8.6 | 262 | 987 | Invention |

TABLE 6

| | Manufacturing Process | Abrasion Resistance Ratio | Hardness (HB) | Amount of Precipitates of 1.0 μm (number/mm²) | |
|---|---|---|---|---|---|
| V | RQ | 8.7 | 432 | 623 | Invention |
| W | RQ | 10.2 | 454 | 1631 | Invention |
| X | RQ | 9.2 | 401 | 903 | Invention |
| Y | RQ | 9.9 | 471 | 1197 | Invention |
| Z | RQ | 9.4 | 429 | 1482 | Invention |
| a | RQ | 8.1 | 380 | 950 | Invention |
| b | RQ | 8.5 | 404 | 1389 | Invention |
| c | RQ | 11.3 | 461 | 1615 | Invention |
| ① | RQ | 4.9 | 464 | 52 | Comparison |
| ②-1 | AR | 2.8 | 326 | 38 | Comparison |
| ②-2 | RQ | 5.2 | 481 | 41 | Comparison |
| ③ | RQ | 1.2 | 122 | 118 | Comparison |
| ④ | RQ | 13.1 | 616 | 1529 | Comparison |

What is claimed is:

1. An abrasion-resistant steel consisting essentially of 0.05 to 0.45 wt. % C, 0.01 to 1 wt. % Si, 0.1 to 2 wt. % Mn, 0.05 to 1.5 wt. % Ti and the balance being Fe and inevitable impurities, said steel including at least 200 of precipitates of 1 μm or more in average particle size per 1 mm² and said precipitates containing Ti.

2. The abrasion resistant steel of claim 1, wherein Ti content is from 0.2 to 1.5 wt. %.

3. The abrasion resistant steel of claim 1, wherein said steel includes at least 500 of precipitates of 1 μm or more in average particle size per 1 mm².

4. The abrasion resistant steel of claim 1, wherein said precipitates have an average particle size of from 1 to 50 μm.

5. An abrasion-resistant steel consisting essentially of 0.05 to 0.45 wt. % C, 0.1 to 1 wt. % Si, 0.1 to 2 wt. % Mn, 0.05 to 1.5 wt. % Ti, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % B and the balance being Fe and inevitable impurities, said steel including at least 200 of precipitates of 1 μm or more in average particle size per 1 mm² and said precipitates containing Ti.

6. The abrasion resistant steel of claim 5, wherein Ti content is from 0.2 to 1.5 wt. %.

7. The abrasion resistant steel of claim 5, wherein Cu content is from 0.2 to 1 wt. %, Ni content is from 0.2 to 1.5 wt. %, Cr content is from 0.2 to 1.5 wt. %, Mo content is from 0.1 to 1 wt. % and B content is from 0.0005 to 0.005 wt. %.

8. The abrasion resistant steel of claim 5, wherein said steel includes at least 500 of precipitates of 1 μm or more in average particle size per 1 mm².

9. The abrasion resistant steel of claim 5, wherein said precipitates have an average particle size of from 1 to 50 μm.

10. An abrasion-resistant steel consisting essentially of 0.05 wt. % to 0.45 wt. % C, 0.1 to 1 wt. % Si, 0.1 to 2 wt. % Mn, 0.05 to 1.5 wt. % Ti, at least one element selected from the group consisting of 0.005 to 1 wt. % Nb and 0.01 to 1 wt. % V and the balance being Fe and inevitable impurities, said steel including at least 200 of precipitates of 1 μm or more in average particle size per 1 mm² and said precipitates containing Ti.

11. The abrasion resistant steel of claim 10, wherein Ti content is from 0.2 to 1.5 wt. %.

12. The abrasion resistant steel of claim 10, wherein Nb content is from 0.01 to 0.5 wt. % and V content is from 0.03 to 0.5 wt. %.

13. The abrasion resistant steel of claim 10, wherein said steel includes at least 500 of precipitates of 1 μm or more in average particle size per 1 mm².

14. The abrasion resistant steel of claim 10, wherein said precipitates have an average particle size of from 1 to 50 μm.

15. An abrasion-resistant steel consisting essentially of 0.05 to 0.45 wt. % C, 0.1 to 1 wt. % Si, 0.1 to to 2 wt. % Mn, 0.05 to 1.5 wt. %. Ti, at least one element selected from the group consisting of 0.1 to 2 wt. % Cu, 0.1 to 10 wt. % Ni, 0.1 to 3 wt. % Cr, 0.1 to 3 wt. % Mo and 0.0003 to 0.01 wt. % B, at least one element selected from the group consisting of 0.005 to 1 wt. % Nb and 0.01 to 1 wt. % V and the balance being Fe and inevitable impurities, said steel including at least 200 of precipitates of 1 μm or more in average particle size per 1 mm² and said precipitates containing Ti.

16. The abrasion resistant steel of claim 5, wherein Ti content is from 0.2 to 1.5 wt. %.

17. The abrasion resistant steel of claim 15, wherein said steel includes at least 500 of precipitates of 1 μm or more in average particle size per 1 $mm^2$.

18. The abrasion resistant steel of claim 15, wherein said precipitates have an average particle size of from 1 to 50 μm.

19. The abrasion resistant steel of claim 3, wherein said precipitates have an average particle size of from 1 to 50 μm.

20. The abrasion resistant steel of claim 19, wherein Ti content is from 0.2 to 1.5 wt. %.

21. The abrasion resistant steel of claim 8, wherein said precipitates have an average particle size of from 1 to 50 μm.

22. The abrasion resistant steel of claim 21, wherein Ti content is from 0.2 to 1.5 wt. %, Cu content is from 0.2 to 1 wt. %, Ni content is from 0.2 to 1.5 wt. %, Cr content is from 0.2 to 1,5 wt. %, Mo content is from 0.1 to 1 wt. % and B content is from 0.0005 to 0.005 wt. %.

23. The abrasion resistant steel of claim 13, wherein said precipitates have an average particle size of from 1 to 50 μm.

24. The abrasion resistant steel of claim 23, wherein Ti content is from 0.2 to 1.5 wt. %, Nb content is from 0.01 to 0.5 wt. % and V content is from 0.03 to 0.5 wt. %.

25. The abrasion resistant steel of claim 17, wherein said precipitates have an average particle size of from 1 to 50 μm.

26. The abrasion resistant steel of claim 23, consisting essentially of 0.32 wt. % C, 0.41 wt. % Si, 1.51 wt. % Mn, 0.091 wt. % Nb, 0.38 wt. % Ti and 0.0049 wt. % N, and the balance Fe and inevitable impurities.

27. The abrasion resistant steel of claim 23, consisting essentially of 0.33 wt. % C, 0.37 wt. % Si, 1.62 wt. % Mn, 0.154 wt. % Nb, 0.98 wt. % Ti and 0.0045 wt. % N, and the balance Fe and inevitable impurities.

28. The abrasion resistant steel of claim 25, consisting essentially of 0.33 wt. % C, 0.26 wt. % Si, 0.62 wt. % Mn, 0.88 wt. % Cr, 0.23 wt. % Mo, 0.070 wt. % Nb, 0.44 wt. % Ti, 0.0015 wt. % B and 0.0033 wt. % N, and the balance Fe and inevitable impurities.

29. The abrasion resistant steel of claim 25, consisting essentially of 0.28 wt. % C, 0.35 wt. % Si, 0.71 wt. % Mn, 0.95 wt. % Cr, 0.26 wt. % Mo, 0.453 wt. % Nb, 0.47 wt. % Ti, 0.0012 wt. % B and 0.0034 wt. % N, and the balance Fe and inevitable impurities.

30. The abrasion resistant steel of claim 25, consisting essentially of 0.30 wt. % C, 0.37 wt. % Si, 0.70 wt. % Mn, 0.95 wt. % Cr, 0.24 wt. % Mo, 0.219 wt. % Nb, 1.35 wt. % Ti, 0.0009 wt. % B and 0.0038 wt. % N, and the balance Fe and inevitable impurities.

31. The abrasion resistant steel of claim 25, consisting essentially of 0.18 wt. % C, 0.44 wt. % Si, 1.52 wt. % Mn, 0.38 wt. % Cu, 0.78 wt. % Cr, 0.416 wt. % Nb, 0.050 wt. % V, 0.28 wt. % Ti, 0.0013 wt. % B and 0.0030 wt. % N, and the balance Fe and inevitable impurities.

32. The abrasion resistant steel of claim 23, consisting essentially of 0.31 wt. % C, 0.58 wt. % Si, 1.22 wt. % Mn, 0.212 wt. % Nb, 0.347 wt. % V, 0.16 wt. % Ti, 0.0015 wt. % B and 0.0049 wt. % N, and the balance Fe and inevitable impurities.

33. The abrasion resistant steel of claim 23, consisting essentially of 0.42 wt. % C, 0.72 wt. % Si, 0.89 wt. % Mn, 0.526 wt. % Nb, 0.37 wt. % Ti, 0.0010 wt. % B and 0.0026 wt. % N, and the balance Fe and inevitable impurities.

34. The abrasion resistant steel of claim 25, consisting essentially of 0.38 wt. % C, 0.26 wt. % Si, 1.02 wt. % Mn, 0.56 wt. % Cu, 0.27 wt. % Cr, 0.062 wt. % Nb, 0.472 wt. % V, 0.32 wt. % Ti, and 0.0041 wt. % N, and the balance Fe and inevitable impurities.

35. The abrasion resistant steel of claim 25, consisting essentially of 0.27 wt. % C, 0.33 wt. % Si, 0.73 wt. % Mn, 0.32 wt. % Cr, 0.261 wt. % V, 0.41 wt. % Ti, and 0.0055 wt. % N, and the balance Fe and inevitable impurities.

36. The abrasion resistant steel of claim 25, consisting essentially of 0.32 wt. % C, 0.41 wt. % Si, 0.82 wt. % Mn, 0.29 wt. % Cr, 0.583 wt. % V, 0.48 wt. % Ti, 0.0012 wt. % B and 0.0080 wt. % N, and the balance Fe and inevitable impurities.

37. The abrasion resistant steel of claim 23, consisting essentially of 0.28 wt. % C, 0.35 wt. % Si, 1.18 wt. % Mn, 1.77 wt. % Cr, 0.39 wt. % Ti, 0.0011 wt. % B and 0.0128 wt. % N, and the balance Fe and inevitable impurities.

38. The abrasion resistant steel of claim 23, consisting essentially of 0.35 wt. % C, 0.12 wt. % Si, 0.96 wt. % Mn, 0.41 wt. % Cu, 1.59 wt. % Ni, 0.12 wt. % Cr, 0.58 wt. % Mo, 0.50 wt. % Ti, and 0.0052 wt. % N, and the balance Fe and inevitable impurities.

39. The abrasion resistant steel of claim 23, consisting essentially of 0.40 wt. % C, 0.44 wt. % Si, 0.76 Wt. % Mn, 1.33 wt. % Cr, 0.89 wt. % Mo, 0.45 wt. % Ti, and 0.0184 wt. % N, and the balance Fe and inevitable impurities.

* * * * *

UNITED STATES PATENT AND TRADEMARK OFFICE

CERTIFICATE OF CORRECTION

PATENT NO. : 5,284,529

DATED : February 8, 1994

INVENTOR(S) : SHIKANAI et al

It is certified that error appears in the above-identified patent and that said Letters Patent is hereby corrected as shown below:

Column 1, lines 11-16, delete all of the subject matter on these lines and replace it with --Serial No. 07/621,587 was replaced by continuation application Serial No. 07/899,105 which issued as Patent No. 5,236,521. An allowed application entitled ABRASION-RESISTANT STEEL directed to related subject matter Serial No. 07/847,726 was filed March 6, 1992. Said Patent No. 5,236,521 and said application Serial No. 07/847,726 are--.

Signed and Sealed this

Second Day of January, 1996

Bruce Lehman

*Attest:*

BRUCE LEHMAN

*Attesting Officer*

*Commissioner of Patents and Trademarks*